US006708612B1

(12) United States Patent
Schmid

(10) Patent No.: US 6,708,612 B1
(45) Date of Patent: Mar. 23, 2004

(54) MODULAR PRINTING MACHINE SYSTEM FOR PRINTING ON SHEETS

(75) Inventor: Gotthard Schmid, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 55 days.

(21) Appl. No.: 09/688,921

(22) Filed: Oct. 16, 2000

(30) Foreign Application Priority Data

Oct. 15, 1999 (DE) ..... 199 49 752

(51) Int. Cl.[7] ..... B41F 5/16
(52) U.S. Cl. ..... 101/183; 101/232
(58) Field of Search ..... 101/177, 181, 101/183, 232

(56) References Cited

U.S. PATENT DOCUMENTS

| | | | | |
|---|---|---|---|---|
| 4,393,386 A | | 7/1983 | Di Giulio | |
| 4,569,284 A | * | 2/1986 | Witczak | 101/183 |
| 4,799,664 A | * | 1/1989 | Burger | 271/204 |
| 4,930,414 A | * | 6/1990 | Wirz | 101/183 |
| 4,976,197 A | | 12/1990 | Yamanari et al. | |
| 5,101,224 A | | 3/1992 | Freed, Jr. | |
| 5,377,587 A | | 1/1995 | Köbler | |
| 5,660,108 A | | 8/1997 | Pensavecchia | |
| 5,909,708 A | * | 6/1999 | Bolza-Schunemann | 101/177 |
| 6,019,046 A | | 2/2000 | Rodi | |
| 6,101,939 A | * | 8/2000 | Giori et al. | 101/177 |
| 6,240,843 B1 | * | 6/2001 | Kruger et al. | 101/183 |

FOREIGN PATENT DOCUMENTS

| | | |
|---|---|---|
| DE | 42 17 576 C2 | 12/1992 |
| DE | 93 12 487.2 | 11/1993 |
| DE | 42 42 259 A1 | 6/1994 |
| DE | 43 03 797 A1 | 8/1994 |
| DE | 195 03 619 A1 | 8/1996 |
| DE | 195 13 536 A1 | 10/1996 |
| DE | 197 04 003 A1 | 8/1998 |
| DE | 197 43 770 A1 | 4/1999 |
| DE | 199 01 698 A1 | 8/1999 |

* cited by examiner

*Primary Examiner*—Ren Yan
(74) *Attorney, Agent, or Firm*—Laurence A. Greenberg; Werner H. Stemer; Gregory L. Mayback

(57) ABSTRACT

A modular printing machine system for printing on sheets, including a first printing machine of satellite construction type having a central first impression cylinder and at least four printing devices assigned thereto, a second printing machine, and a coupling device for coupling the printing machines to one another for in-line operation thereof, includes a transport device of the printing machine system, for transporting the sheets, and a non-impact printer assigned to the transport device.

10 Claims, 4 Drawing Sheets

MODULAR PRINTING MACHINE SYSTEM FOR PRINTING ON SHEETS

BACKGROUND OF THE INVENTION

Field of the invention

The invention relates to a modular printing machine system for printing on sheets, comprising a first printing machine of satellite construction type, with a central first impression cylinder and at least four printing devices assigned thereto, a second printing machine, and a coupling device for coupling the printing machines with one another for in-line operation thereof.

In the published German Patent Document DE 197 43 770 A1, there is described such a system, which includes a satellite printing-unit group as the first printing machine, an imprinting-unit group as the second printing machine, and a connecting element as a coupling device. The imprinting-unit group includes a first and a second printing form, with which various imprints can be added to the four-color images printed in the satellite printing-unit group. The printing forms are one-time imageable printing forms, i.e., whereon printing images may be applied only once, assignable to the master system, the printing image being storable but not eraseable, the production of the printing image requiring an expenditure of a given length of time of, for example, twelve minutes. Therefore, with the system described in this German patent document it is not possible for each sheet to be printed by the system in a print job to be given a different, individual imprint, for example for the purpose of addressing, personalization or numbering.

The prior state of the art is described further in U.S. Pat. No. 5,660,108, and in the published German Patent Documents DE 43 03 797 A1 and DE 195 03 619 A1.

Advertising matter, for the production of which, printing machine systems of the foregoing general type are particularly well suited, often require such individual imprints, however, for example in order to address the addressee in the advertising matter personally.

In the published German Patent Document DE 197 04 003 A1 representing an even further state of the prior art, a description is given of a method for imprinting one of a multiplicity of individualizing identifications by a laser printer or ink jet printer in a sheet-fed printing machine.

The sheet-fed printing machine does not belong to a printing machine system with printing machines that are couplable together, and therefore cannot be used very variably.

SUMMARY OF THE INVENTION

In light of these inadequacies of the prior art, it is accordingly an object of the invention to provide a modular printing machine system for printing on sheets with which the sheets can be given individual imprints.

With the foregoing and other objects in view, there is provided, in accordance with one aspect of the invention, a modular printing machine system for printing on sheets, including a first printing machine of satellite construction type having a central first impression cylinder and at least four printing devices assigned thereto, a second printing machine, and a coupling device for coupling the printing machines to one another for in-line operation thereof, comprising a transport device of the printing machine system, for transporting the sheets, and a non-impact printer assigned to the transport device.

In accordance with another feature of the invention, the transport device is constructed for transporting the sheets along a linear transport path.

In accordance with a further feature of the invention, the transport device has at least one tongs-type gripper lying on a side of a sheet held in the tongs-type gripper for printing thereon by the non-impact printer, the tongs-type gripper having an ultra-flat construction so that, when the sheet is being transported past the non-impact printer, the tongs-type gripper is guidable collision-free through a narrow gap formed In accordance with an added feature of the invention, the tongs-type gripper is less than 1.0 mm thick, more particularly, less than 0.5 mm thick.

In accordance with an additional feature of the invention, the transport device is a transport belt.

In accordance with yet another feature of the invention, the transport belt is a suction belt selected from the group consisting of suction belts formed of air-permeable material and of a material formed with air passages, respectively, the suction belt, in order to hold the sheet thereon, having a suction device assigned thereto for sucking the sheet against the suction belt.

In accordance with yet a further feature of the invention, the transport device is selected from the group consisting of electromagnetic linear drives and linear motors, respectively, and includes stators and at least one rotor, the rotor being constructed so as to carry the sheets, and the stators being disposed along a transport path of the sheets and being constructed to produce a traveling electromagnetic field for forwardly driving the rotor.

In accordance with yet an added feature of the invention, the transport device is constructed as a chain gripper formed of a chain and at least one gripper bar secured thereto.

In accordance with yet an additional feature of the invention, the non-impact printer is a printer selected from the group consisting of ink jet printers and laser printers, respectively.

In accordance with another aspect of the invention, there is provided a modular printing machine system for printing on sheets, including a first printing machine having a sheet feeder and being of satellite construction type with a central first impression cylinder and at least four printing devices assigned thereto, a second printing machine including a sheet delivery and a second impression cylinder, and a coupling device for coupling the printing machines to one another for in-line operation thereof, the second printing machine comprising a second impression cylinder, the first and the second impression cylinders being of different sizes.

In accordance with another feature of the invention, the modular printing machine system according to the other aspect of the invention comprises a transport device for transporting the sheets, and a non-impact printer assigned to the transport device.

In accordance with a concomitant aspect of the invention, there is provided a modular printing machine system for printing on sheets, comprising a first printing machine having a first impression cylinder, a second printing machine having a second impression cylinder, and a coupling device for coupling the first and the second printing machines to one another for in-line operation thereof, the first and the second impression cylinders being of different sizes.

Thus, the printing machine system according to the invention includes a transport device and a non-impact printer, which is arranged adjacent to the transport device. While the transport device transports the sheets past the non-impact printer, the latter can provide the sheets with individual imprinted motifs. For example, using the non-impact printer, each sheet of a print job, which includes many sheets successively passing through the printing machine system, can be provided with a different imprinted motif.

Other features which are considered as characteristic for the invention are set forth in the appended claims.

Although the invention is illustrated and described herein as embodied in a modular printing machine system for printing on sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
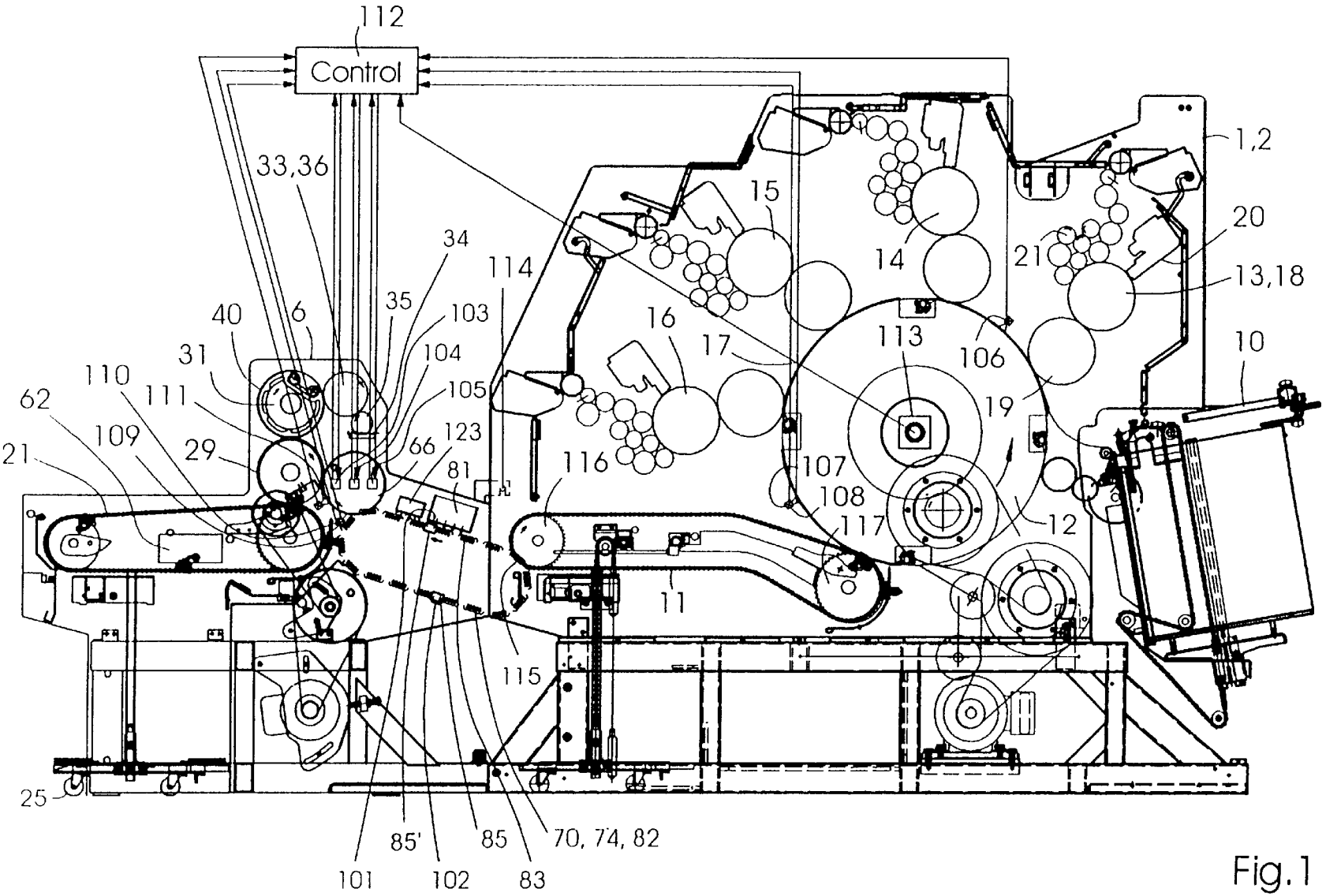
FIG. 1 is a diagrammatic and schematic side elevational view of a first embodiment of a modular printing machine system according to the invention.

Referring now to FIGS. 1 to 4 of the drawings, there is shown therein a first printing machine 1 which, in order to form a modular printing machine system 2 to 5, respectively, can selectively be coupled to a second printing machine 6 (note FIG. 1), to a second printing machine 7 (note FIG. 2), to a second printing machine 8 (note FIG. 3) or to a second printing machine 9 (note FIG. 4), and which includes a sheet feeder 10 and a sheet delivery 11 and all the further subassemblies needed for a separate operation from the respective second printing machine 6, 7, 8 or 9.

In addition, the first printing machine 1 includes a common impression cylinder 12, around which four printing devices 13 to 16 are arranged, by which a sheet 17 lying on the impression cylinder 12 is printed successively with the colors black, cyan, magenta and yellow in the offset process, preferably using dry offset, i.e., without dampening solution. Each of the printing devices 13 to 16 includes a form cylinder 18 and an applicator cylinder 19, whereon a rubber blanket is mounted and serves for transferring the respective ink from the form cylinder 18 to the sheet 17. The circumference of the impression cylinder 12, which is equipped with four rows of grippers, is four times as large as the circumference of the form cylinder 18, and also four times as large as the circumference of the applicator cylinder 19. Each form cylinder 18 has a laser source assigned thereto as an imaging device 20 for forming an image thereon, an operation which is performed within the printing machine 1 by laser radiation, and an inking unit 21 for inking during the printing. The first printing machine 1 may be a machine of the "Quickmaster DI 46-4" type produced by Heidelberger Druckmaschinen AG.

Each of the second printing machines 6 to 9 includes a sheet delivery 21 to 24 with a chain gripper, is also equipped with a chassis or undercarriage 25 to 28 which is withdrawable if necessary, and has two side walls with a thickness and distance from one another corresponding to those of the first printing machine 1, so that the second printing machine 6 to 9 can be docked without difficulty with and onto the first printing machine 1.

The second printing machines 6 and 7 are constructed as varnishing machines and, respectively, include an impression cylinder 29, 30 with grippers and, respectively, an applicator cylinder 31, 32. In order to feed varnish, a roller engages the applicator cylinder 31 and, serving as a metering roller 33, together with a dip roller 35 that scoops the varnish out of a trough 34, forms a metering device 36 for producing a uniform film of varnish over the printing width. The second printing machine 7 also has such a zoneless metering device 37, which, in an anilox construction type, includes a screen roller 38 rolling on the applicator cylinder 32 and a doctor blade 39 formed as a chamber-type doctor blade and engaging the screen roller 38. The circumferential length of each cylinder 29 to 32 and of the screen roller 38 corresponds to that of the form cylinder 18. On each of the applicator cylinders 31 and 32, a rubber blanket 40 for varnishing the entire area of the sheet 17, or a flexographic printing form 41 for spot varnishing can selectively be spread. In the latter case, the applicator cylinder 31, 32 is a form 20 cylinder. Of course, a special ink can be printed with each second printing machine 6 and 7 instead of the varnish.

The second printing machine 8 is a slightly modified single-color printing machine of the "Printmaster QM 46-1" type, and the second printing machine 9 is a slightly modified two-color printing machine of the "Printmaster QM 46-2" type, which are produced by Heidelberger Druckmaschinen AG. The aforementioned machine types can also form the basis for the second printing machines 6 and 7; the modifications which would have to be performed for this purpose would then be somewhat more extensive.

Each of the second printing machines 8 and 9 includes an applicator cylinder 42, 43 which, as a blanket cylinder, transfers the ink from at least one printing form cylinder 44, 45, 46 to the sheet 17 lying on an impression cylinder 47, 48 in the offset process. The applicator cylinder 43 operates as a collecting cylinder together with the two printing form cylinders 45 and 46, in that the rotating applicator cylinder 43, respectively, successively picks up a special ink from the printing form cylinders 45 and 46 rolling thereon and then applies the two special inks at the same time to the sheet 17. Each printing form cylinder 44 to 46 has a dampening unit 49 to 51 assigned thereto for dampening purposes, and an inking unit 42 to 54, constructed as a vibrator-type inking unit, for inking it. The respective dampening unit 49 to 51 can be dispensed with in the case of a second printing machine 8, 9 that operates in the dry offset process. Each printing form cylinder 44 to 46 can have a laser source assigned thereto as an imaging device 55 to 57 for the purpose of forming an image thereon within the second printing machine 8 and 9 by laser radiation. The printing form cylinder 46, the inking unit 54, if appropriate the dampening unit 51 and if appropriate the imaging device 57 are mounted between side plates which are separate from the side walls of the printing machine 9 but correspond to the latter in terms of distance and thickness and, together, constitute a structural unit in the form of a printing module 58, which may be placed on the side walls.

Except for the printing module 58, the second printing machines 8 and 9 are identical to one another. By omitting the printing module 58, the second printing machine 9 can be converted to a single-color printing machine, which corresponds to that shown in FIG. 3. By adding the printing module 58, the second printing machine 8 can be converted to a two-color printing machine, which corresponds to that shown in FIG. 4. As a result of this building-block system, the manufacturer's production costs can be kept low.

In order to provide the sheets 17 with imprints that can be varied from sheet to sheet during continuous operation of the machine, for example continuous numbering or codes, an imprinting unit 59 with a stamping shaft 60 can be integrated into both the second printing machine 8 and the second printing machine 9, as is illustrated by using the second printing machine 8 as an example.

In order to dry the sheet 17 before it is delivered by the sheet delivery 21 or 23, a dryer 61 can also be integrated, instead of the single printing unit 59, into each of the aforementioned second printing machines 8 and 9, as is illustrated by the use of the second printing machine 9 as an example.

A dryer 62 to 65 can likewise be integrated into the sheet delivery 21 to 24 of the second printing machine 6 to 9, the dryer 62 to 65 being arranged between the two runs or strands of the chain gripper of the respective sheet delivery 21 to 24. The dryer 62 to 65 is assigned to the lower run or strand, which conveys the sheets 17 and from which the sheets 17 are allowed to fall onto a sheet pile belonging to the respective sheet delivery 21 to 24. The dryer 62 to 65 acts upon the front side of the sheet 17 freshly printed in the second printing machine 6 to 9 while the sheet is being transported past the dryer 62 to 65 by the chain gripper.

For the purpose of transporting sheets from the first printing machine 1 into the respective second printing machine 6 to 9, a feeding device 66 to 69 and a modular transport device 70 to 73 are installed between the sheet delivery 11 of the first printing machine 1 and the second impression cylinder 29, 30, 47 or 48 of the second printing machine 6 to 9. Each of the transport devices 70 to 73, which are described in greater detail hereinbelow, can be installed instead of each of the other transport devices 70 to 73. For example, the transport device 70 can also be integrated, instead of the transport device 71, into the printing machine system 3. The feeding devices 66 to 69 are identical with one another.

Each transport device 70 to 73 is arranged between the first impression cylinder 12 and the respective second impression cylinder 29, 30, 47 or 48 to transport the sheets from the impression cylinder 12 to the second impression cylinder 29, 30, 47 or 48, and is constructed to transport the sheets 17 along a linear transport path 74 to 77.

Figure 2:
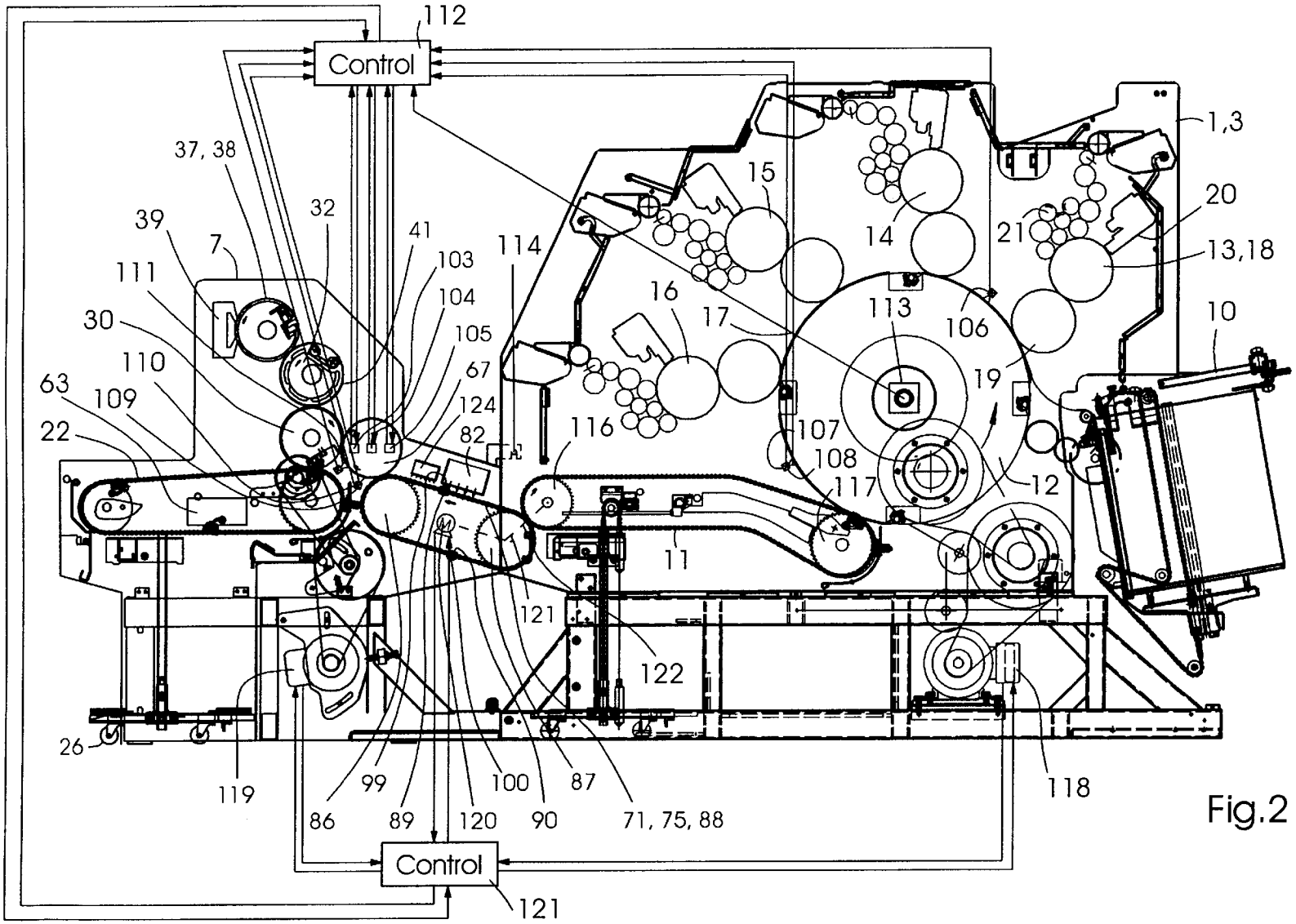
FIG. 2 is a view like that of FIG. 1 of a second embodiment of the modular printing machine system according to the invention, which differs from the first embodiment.
Figure 3:
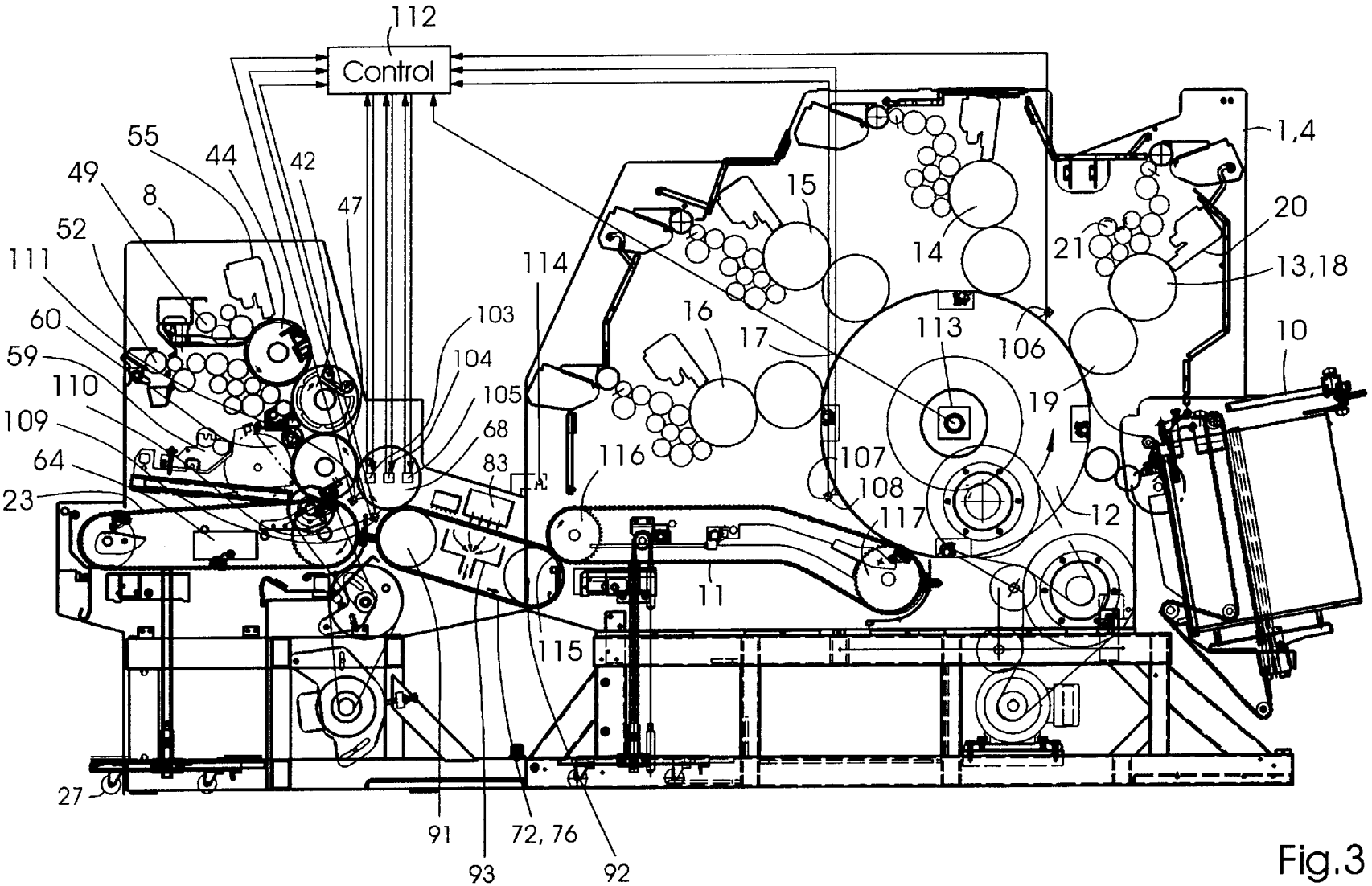
FIG. 3 is a view like those of FIGS. 1 and 2 of a third embodiment of the modular printing machine system according to the invention, which differs from the first and the second embodiments.
Figure 4:
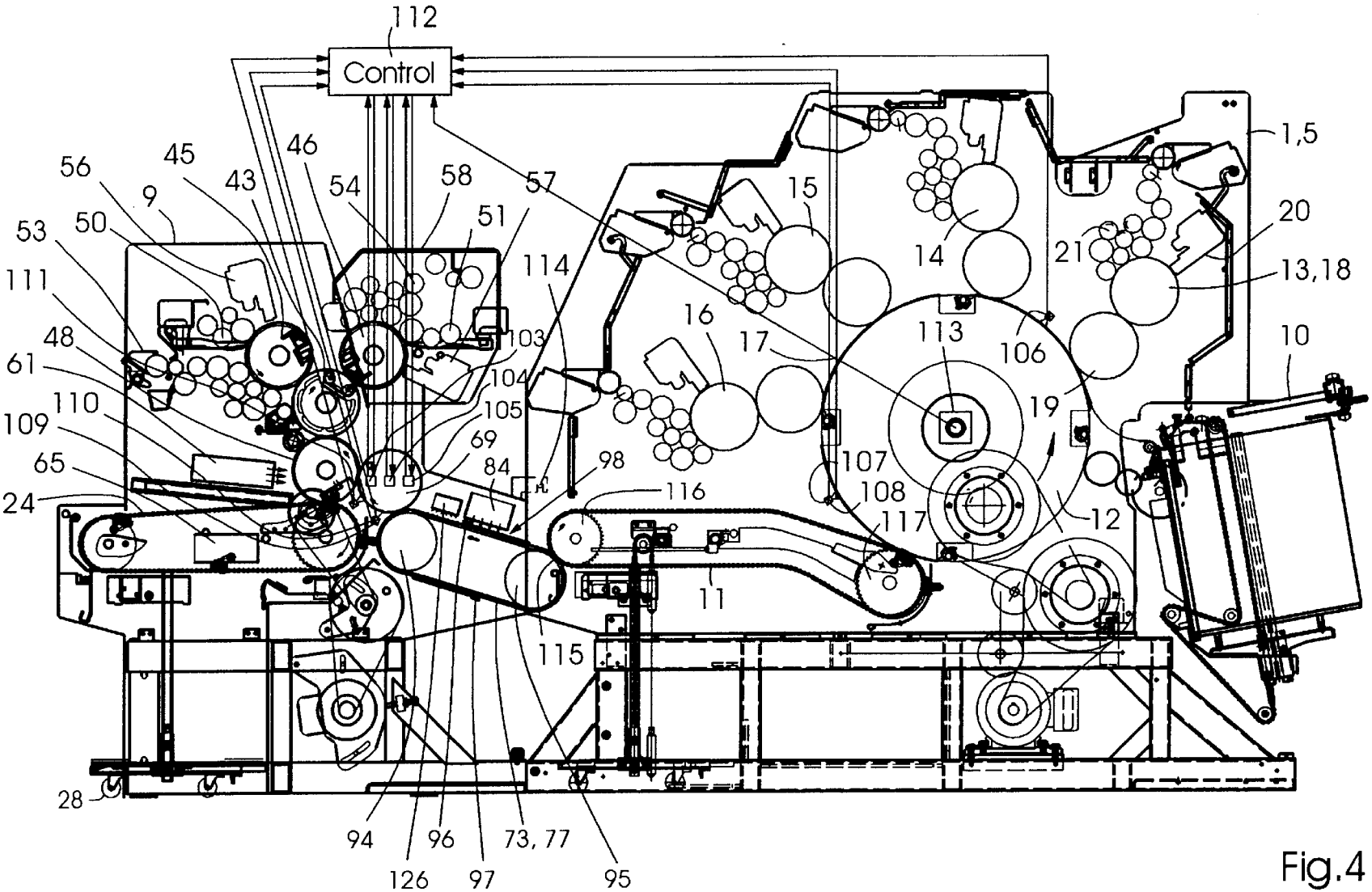
FIG. 4 is a view like those of FIGS. 1, 2 and 3 of a fourth embodiment of the modular printing machine system according to the invention, which differs from the first, second and third embodiments.

An electric motor drive 118 which drives the first printing machine 1 and, in particular, the rotating system of the first impression cylinder 12 and the revolving system of the sheet delivery 11, a drive 119 which drives the second printing machine 6 to 9 and, in particular, the rotating system of the second impression cylinder 29, 30, 47 or 48, and an electric motor drive 120 which drives the transport device 70 to 73 and, in particular, the revolving system thereof, are linked to an electronic control device 121 and, via the latter, are linked to one another, in terms of control technology, for the synchronization of the drives 118 to 120, as is shown by way of example in the printing machine system 3 in FIG. 2. In order to prevent the gripper bars 89 and 90 of the transport device 71 from colliding with the delivery gripper bars, even in the case of accidents and, for example, in the event of failure of the control device 121, formlocking or positive forcible control is provided in the form of a gear mechanism 122 linking the transport device 71 with the sheet delivery 11, the gear mechanism 122 having one gearwheel assigned to the sheet delivery 11 and, for example, arranged coaxially with the chain sprocket 116, and having another gearwheel assigned to the transport device 71 and arranged, for example, coaxially with the chain sprocket 87, the two gearwheels having an increased tooth clearance with respect to one another and coming into tooth-flank contact with one another only in the event of an accident.

The transport device 70 to 73 has a non-impact printer 78 to 81 assigned thereto and, following the latter in the sheet transport direction, a dryer 123 to 126. The non-impact printer 78 to 81 prints the sheet 17, and the dryer 123 to 126 dries the sheet 17, while the latter is transported by the transport device 70 to 73 along the transport path 74 to 77 and past the non-impact printer 78 to 81 and past the dryer 123 to 126. The non-impact printer 78 to 81 is preferably an ink jet printer, having nozzles from which droplets of ink are expelled by piezoelectric pumps.

Each of the dryers 61 to 65 and 123 to 126 may be an IR (infrared radiation) dryer, a UV (ultraviolet radiation) dryer and, in particular, a so-called UV excimer dryer, which operates without forming any ozone and, with the monochromatic UV radiator thereof at 308 and 222 nanometers light wavelength, respectively, does not emit any heat radiation. Such a UV excimer dryer has become known heretofore, for example, from the publication "Druckwelt" (Printing World), March 1999 Issue, and was developed, for example, by the Sächsisches Institut der Druckindustrie [Saxon Institute for the Printing Industry] (SID), Leipzig, Germany, based upon blue-light modules with mercury-free UV radiators from the firm Heraeus Noblelight GmbH, Kleinostheim, Germany.

The dryers 123 to 126 are provided for drying the ink-jet ink printed by the non-impact printer 78 to 81, which can also be a UV-curable ink, the drying being rapid and essentially completed before the sheet 17 is printed or varnished in the second printing machine 6 to 9. The dryers 61 to 65 are provided for drying the entire sheet 17 before it is delivered into the sheet delivery 21 to 24.

Instead of the ink jet printer, a laser printer can often also be provided as the non-impact printer 81 to 84, in which cases the dryer 123 to 126 may be dispensed with.

The advantage of the non-impact printer 81 to 84 over an imprinting unit which is mechanically connectable, such as the imprinting unit 59, is that, by using the non-impact printer 81 to 84, addresses, personalizations and virtually all conceivable motifs can also be printed onto the sheet 17, it being possible for the type and sequence of the motifs to be updated during the uninterrupted running of the printing machine system 2 to 5. In the imprinting unit 59, the type, the number and the sequence of the motifs, which can be continuous numbering, codes and the like, for example, here, are predetermined by the form and indexing of the stamps or punches, or numbering wheels used in the imprinting unit 59, which can be replaced only when the machine is at a standstill.

The transport device 70 is constructed as an electromagnetic linear drive and linear motor, respectively, which comprises stators 82 and 83 and at least one rotor 84 and 85, the rotor 84 and 85 being equipped with at least one otherwise non-illustrated sheet holding element for carrying the sheets 17, and the stators 82 and 83 being arranged along the transport path 74 of the sheets 17 and being constructed so as to produce a traveling electromagnetic field for driving the rotor 84 and 85 forward.

The transport device 71 is constructed as a chain gripper, which is formed of a linked chain 88 revolving about two shafts provided with chain sprockets 86 and 87, at least one gripper bar 89, 90 carrying the sheet 17 is fastened to the chain 88.

The transport device 72 is a suction belt that revolves around two shafts 91 and 92, is formed of an air-permeable material or is provided with air passages and, in order to hold the sheet 17 on the suction belt, the latter has a pneumatic suction device 93 assigned thereto which attracts the sheet 17 by suction through the suction belt.

The transport device 73 is a transport belt, which revolves around two shafts 94 and 95, and has at least one tongs-type gripper 96, 97 for holding the sheet 17, the tongs-type gripper 96, 97 lying on that side of the thereby held sheet 17 which is to be printed by the non-impact printer 84 and, because of the ultra-flat construction thereof, as the sheet 17 is being transported past the non-impact printer 84, the tongs-type gripper 96, 97 is guidable without collision through a narrow gap 98 formed between the non-impact printer 84 and the sheet 17. Each tongs-type gripper 96, 97 moving relative to a gripper pad in order to clamp the sheet and clamping the sheet between itself and the gripper pad, is less than 1.0 mm thick, in particular less than 0.5 mm thick, and thus projects barely in the direction of the non-impact printer 84.

In addition, each gripper bar 89, 90 of the transport device 71, and each rotor 85 and 85' of the transport device 70, can be equipped with such an ultra-flat tongs-type gripper 99 to 102 as a sheet-holding element.

The feeding device 66 to 69 accepts the sheet 17 from the respective transport device 71 to 73, which in turn accepts the sheet 17 from the sheet delivery, which is constructed as a chain gripper revolving around chain sprockets 116 and 117 and provided with otherwise non-illustrated delivery gripper bars. The feeding device, which serves to transfer the sheet to the second impression cylinder 29, 30, 47 or 48 and is constructed as a feed drum, has at least one adjusting or actuating device 103 to 105 assigned thereto.

In order to simplify the following explanations, like reference characters are used in FIGS. 1 to 4 for sensors, electronic control devices and the adjusting or actuating devices which are constructionally and functionally identical in all the printing machine systems 2 to 5.

The first impression cylinder 12 has at least one sensor 106 to 108 assigned thereto for monitoring the position of a sheet 17 transported by the impression cylinder 12, and the feeding device 66 to 69 has at least one further sensor 109 to 110 assigned thereto for monitoring the position of the sheet 17 to be transferred from the feeding device 66 to 69 to the second impression cylinder 29, 30, 47 or 48. The at least one sensor 107 and 108 and the at least one further sensor 109 and 110 are arranged to monitor the position of a leading edge of the sheet and, via an electronic control device 112, are linked to the adjusting or actuating device 103 that is used to adjust the circumferential register of the feeding device 66 to 69. If only a single sensor 107 and 109 is assigned to the first impression cylinder 12 and the feeding device 66 to 69, respectively, for monitoring the circumferential register, then the sensor, respectively, is situated in the vicinity of the center of the format width of the leading edge of the sheet 17 passing by the sensor 107 and 109.

The sensors 107 and 108 are preferably arranged offset from one another in the axial direction of the first impression cylinder 12, and form a first pair of sensors, and the sensors 109 and 110 are likewise preferably arranged offset from one another in the axial direction of the feeding device 66 to 69, and form a second pair of sensors. In terms of their pairwise arrangement, the sensors 107 to 110 are not arranged in the vicinity of the center of the sheet but, as a function of the format, adjustably close to the side edges of the sheet, so that the sensors 107 and 109 register the leading edge close to one side edge of the sheet, and the sensors 108 and 110 register the leading edge close to the other side edge of the sheet. The sensor pairs can be used not only to monitor the circumferential register but, alternatively or additionally, also to monitor the diagonal or skew register. In this case, each of the four sensors 107 to 110 is linked via the electronic control device 112 to the adjusting or actuating device 104 serving to adjust the diagonal register of the feeding device 66 to 69 and, with simultaneous monitoring of the circumferential register, also linked to the adjusting or actuating device 103.

In addition, an incremental encoder 113 for registering the machine angle of the first printing machine 1, i.e., the rotary angle position of the rotating first impression cylinder 12, is linked to the electronic control device 112 and, via the latter, to the sensors 107 to 110.

If the control device 112 establishes that there are deviations between the register values from the pair of sensors 107 and 108 or from the single sensor 107 in relation to the pair of sensors 109 and 110 or the single sensor 109, the control device 112 controls the adjusting or actuating device 103 in a manner that the circumferential register of the feeding device 66 to 69 is displaced in the circumferential direction of the feeding device 66 to 69, corresponding to a register-maintaining setting. If the control device 112 establishes that the monitored values from the pair of sensors 109 and 110 deviate from the monitored values of the pair of sensors 107 and 108, the control device 112 controls the adjusting or actuating device 104 in a manner that the diagonal register of the feeding device 66 to 69 is set in a register-maintaining manner by changing the skew setting or parallel setting thereof.

The sensors 106 and 111 are arranged so as to monitor the position of one side edge of the sheet 17, and are linked via the electronic control device 112 to the adjusting or actuating device 105 serving to adjust the lateral register of the feeding device. The sensor 106 measures the position of the sheet 17 on the first impression cylinder 12 in the axial direction of the latter, and signals the measured position to the control device 112. The sensor 111 likewise measures the lateral position of the sheet 17 on the feeding device 66 to 69 and, in turn, signals the measured position to the control device 112, which, in the event of a deviation of the value measured by the sensor 111 from the value measured by the sensor 106, controls the adjusting or actuating device 105 that serves to adjust the lateral register of the feeding device 66 to 69 in a manner that, by displacing the feeding device 66 to 69 axially, the lateral register thereof is adjusted.

The adjustment of the feeding device for correcting the circumferential, diagonal or lateral register is performed only after the trailing edge of the sheet transported by the feeding device 66 to 69 during the displacement thereof has passed by the non-impact printer 81 to 84, and this sheet is no longer being printed by the non-impact printer 81 to 84.

This reliably avoids any distortion of the image printed on the sheet by the non-impact printer 81 to 84 due to the premature displacement of the sheet relative to the yet-printing non-impact printer 81 to 84 by the feeding device 66.

Each of the sensors 106 to 111 is constructed as an optical sensor in the form of a so-called CCD (charge coupled device) line.

Instead of directly monitoring the position of the sheet leading edge or the sheet lateral edge by the respective sensor 106 to 111, register marks, for example register crosses, can be printed in the first printing machine 1 with the applicator cylinder 19 onto the printed image-free sheet margins located at the edge of the sheet, the position of which is registered by the respective sensor 106 to 111, by which the position of the edge of the sheet is monitored indirectly.

After the register corrections described hereinabove have been performed, the feeding device 66 to 69 transfers the sheet 17, which has been printed in-register on the first impression cylinder 12, the register-maintenance of the sheet 17 having from time to time been lost due to the sheet transfer from the sheet delivery 11 to the transport device 70 to 73 at a separating location 115, to the second impression cylinder 29, 30, 47 or 48, again while maintaining register.

Due to possible wear and necessary play in a coupling device 114, one cannot rule out that the respective second printing machine 6 to 9, each time it is coupled to the first printing machine 1, will be offset slightly relative to the latter, by a different amount. This offset manifests itself at the separating location 115, at which the respective transport device 70 to 73 accepts the sheets 17 from the sheet delivery 11, and at which the second printing machine 6 to 9 can be separated from the first printing machine 1. In other words, the sheet delivery 11 transfers the sheets 17 more-or-less in-register to the respective transport device 70 to 73, depending upon the magnitude of the offset.

The possibly inaccurate transfer register between the first printing machine 1 and the second printing machine 6 to 9 is advantageously compensated for by appropriate displacement of the feeding device 66 to 69, so that the sheet 17 is in turn transferred with accurate register from the feeding device 66 to 69 to the respective second impression cylinder 29, 39, 47 or 48.

I claim:

1. A modular printing machine system for printing on sheets, comprising:

a first printing machine of satellite construction type having a central first impression cylinder and at least four printing devices assigned thereto, each of said printing devices including a form cylinder;

a second printing machine;

a coupling device for selectively coupling said first printing machine and said second printing machine to one another for in-line operation thereof;

a transport device for transporting the sheets; and a non-impact printer assigned to said transport device.

2. The modular printing machine system according to claim 1, wherein said transport device is constructed for transporting the sheets along a linear transport path.

3. The modular printing machine system according to claim 1, wherein said transport device has at least one clamping gripper lying on a side of a sheet held in said clamping gripper for printing thereon by said non-impact printer, said clamping gripper having an ultra-flat construction so that, when the sheet is being transported past said non-impact printer, said clamping gripper is guidable collision-free through a narrow gap formed between said non-impact printer and the sheet.

4. The modular printing machine system according to claim 3, wherein said clamping gripper is less than 1.0 mm thick.

5. The modular printing machine system according to claim 1, wherein said transport device is a transport belt.

6. The modular printing machine system according to claim 5, wherein said transport belt is a suction belt selected from the group consisting of suction belts formed of air-permeable material and of a material formed with air passages, respectively, said suction belt, in order to hold the sheet thereon, having a suction device assigned thereto for sucking the sheet against said suction belt.

7. The modular printing machine system according to claim 1, wherein said transport device is selected from the group consisting of electromagnetic linear drives and linear motors, respectively, and includes stators and at least one rotor, said rotor being constructed so as to carry the sheets, and said stators being disposed along a transport path of the sheets and being constructed to produce a traveling electromagnetic field for forwardly driving said rotor.

8. The modular printing machine system according to claim 1, wherein said transport device is constructed as a chain gripper formed of a chain and at least one gripper bar secured thereto.

9. The modular printing machine system according to claim 1, wherein said non-impact printer is a printer selected from the group consisting of ink jet printers and laser printers, respectively.

10. A modular printing machine system for printing on sheets, comprising:

a first printing machine of satellite construction type having a central first impression cylinder and at least four printing devices assigned thereto, each of said printing devices including a form cylinder;

a second printing machine having a second impression cylinder;

a coupling device for selectively coupling said first printing machine and said second printing machine to one another for in-line operation thereof;

a transport device for transporting the sheets, said transport device disposed between said first impression cylinder and said second impression cylinder; and a non-impact printer assigned to said transport device.

* * * * *